US007201297B1

(12) United States Patent
Baziuk

(10) Patent No.: US 7,201,297 B1
(45) Date of Patent: Apr. 10, 2007

(54) ONE PIECE MOLDED CLOTHES HANGER CONSTRUCTION

(76) Inventor: Nelson W. Baziuk, 1020 Puget St., Bellingham, WA (US) 98229

( * ) Notice: Subject to any disclaimer, the term of this patent is extended or adjusted under 35 U.S.C. 154(b) by 322 days.

(21) Appl. No.: 10/859,863

(22) Filed: Jun. 3, 2004

(51) Int. Cl.
*A41D 27/22* (2006.01)

(52) U.S. Cl. ..... 223/85

(58) Field of Classification Search ..... 223/85–98; D6/317–318, 328
See application file for complete search history.

(56) References Cited

U.S. PATENT DOCUMENTS

| | | | | | |
|---|---|---|---|---|---|
| 3,482,746 | A | | 12/1969 | Ferguson | 223/85 |
| 3,792,804 | A | | 2/1974 | Ponzo | 223/85 |
| 4,040,545 | A | * | 8/1977 | Hill | 223/85 |
| 4,415,093 | A | | 11/1983 | Livingston | 211/113 |
| D296,958 | S | * | 8/1988 | Dallaire et al. | D6/317 |
| D375,413 | S | * | 11/1996 | Lin | D6/319 |
| D383,910 | S | * | 9/1997 | Maxwell | D6/328 |
| D393,371 | S | | 4/1998 | Dunn | D6/328 |
| 5,839,629 | A | * | 11/1998 | Zuckerman | 223/85 |
| 5,938,088 | A | * | 8/1999 | Lam | 223/85 |
| 6,041,985 | A | * | 3/2000 | Balser | 223/91 |
| 6,758,378 | B2 | * | 7/2004 | Carmichael | 223/85 |
| 2005/0242134 | A1 | * | 11/2005 | Presser et al. | 223/85 |
| 2006/0175364 | A1 | * | 8/2006 | Simpson et al. | 223/98 |

* cited by examiner

*Primary Examiner*—Shaun R. Hurley
(74) *Attorney, Agent, or Firm*—Sturm & Fix LLP

(57) ABSTRACT

A clothes hanger construction (10) for spacing the bodies of clothes hanger members (20) (20) (20) from one another wherein, the neck portion (21) of each clothes hanger member (20) has an enlarged weight bearing segment (25) having a wide curved bottom that allows the hanger member (20) to rock from side to side on a hanger support pole (100) and wherein the continuously curved sides of the enlarged weight bearing segment (25) are spaced a distance "x" from one another wherein, the value of "x" is at least twice the width "y" of the support arms (22) (24) and leg (23) of the hanger member (20).

4 Claims, 1 Drawing Sheet

ONE PIECE MOLDED CLOTHES HANGER CONSTRUCTION

CROSS REFERENCE TO RELATED APPLICATIONS

The present invention was the subject matter of Document Disclosure Program Registration No. 542,740, filed in the United States Patent and Trademark Office on Dec. 5, 2003.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of clothes hanger constructions in general and in particular to a self spacing, non-tangling configuration for molded plastic hangers.

2. Description of Related Art

As can be seen by reference to the following U.S. Pat. Nos. Des. 393,371; 3,482,746; 4,415,093; and, 3,792,804, the prior art is replete with myriad and diverse arrangements for spacing the bodies of adjacent clothes hangers at spaced intervals.

While all of the aforementioned prior art constructions are more than adequate for the basic purpose and function for which they have been specifically designed, they are uniformly deficient with respect to their failure to provide a simple, efficient, and practical one piece molded plastic clothes hanger construction that facilitates the spacing, sliding and de-angling of clothes hangers in a new and unique manner.

Unfortunately, most of the prior art constructions employ a fairly wide curved flat surface where the neck of a clothes hanger contacts a support rod which makes it very difficult to shift a number of garment laden hangers along the clothes rod surface due to the fact that the clothes hangers cannot rock or tilt relative to the rod as they are laterally displaced.

As a consequence of the foregoing situation, there has existed a longstanding need for a new and improved one piece spacing clothes hanger construction having a beaded neck portion that both spaces adjacent hangers while minimizing the frictional resistance offered by a plurality of hangers sliding along a clothes rod and, the provision of such a construction is the stated objective of the present invention.

BRIEF SUMMARY OF THE INVENTION

Briefly stated, the clothes hanger construction that forms the basis of the present invention comprises a one piece molded plastic clothes hanger member including a neck portion that transitions into a horizontal leg portion that also transitions into a second angled arm portion which joins the neck portion such that the two arm portions and the leg portion define a generally triangular opening.

As will be explained in greater detail further on in the specification, the key feature of novelty in the present invention is that the neck portion of the clothes hanger member is provided with an enlarged weight bearing segment having a continuous curved peripheral surface the cross sectional configuration of which be circular, oval or elliptical in shape.

Furthermore, the cross-sectional width of the weight bearing segment is substantially greater than the cross-sectional width of the remainder of the clothes hanger member such that the bodies of the adjacent hanger members are spaced relative to one another, and the continuous curved peripheral surface of the weight bearing segment of the neck portion of each hanger member allows the hanger members to be tilted as they are slid along the top surface of the clothes hanger support rod.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
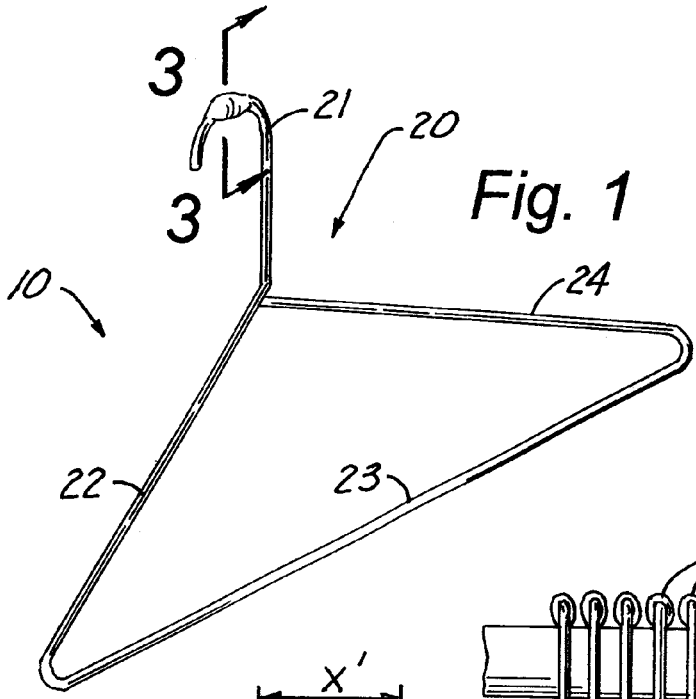
FIG. 1 is a perspective view of the clothes hanger construction that forms the basis of the present invention.

As can be seen by reference to the drawings, and in particularly to FIG. 1, the clothes hanger construction that forms the basis of the present invention is designated generally by the reference number 10. The hanger construction 10 preferably comprises a one piece molded plastic clothes hanger member 20 having a neck portion 21 formed integrally with a first angled arm portion 22 which transitions into a horizontal leg portion 23 that is formed integrally with a second angled arm portion 24 that may be optionally fixedly connected to the first arm portion 22 or the neck portion 21 in a well recognized fashion.

Figure 2:
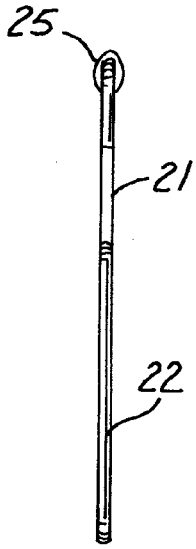
FIG. 2 is a front elevation view of the hanger construction.
Figure 3:
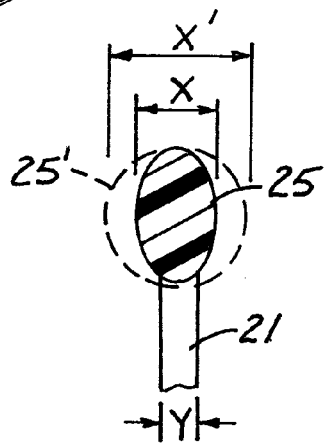
FIG. 3 is an enlarged cross-sectional view taken through line 3—3 of FIG. 1.
Figure 4:
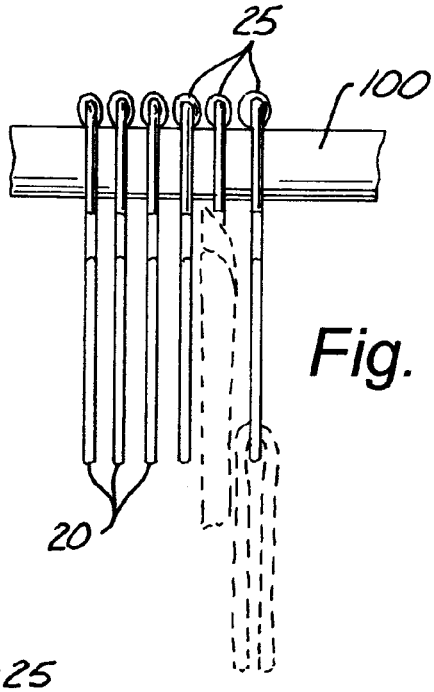
FIG. 4 depicts a plurality of the clothes hanger constructions suspended from a hanger support pole.
Figure 5:
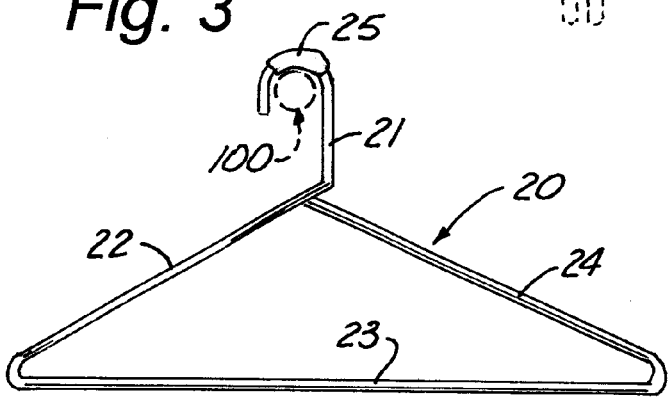
FIG. 5 is a side elevation view of the hanger construction.

As was mentioned previously and which can best be appreciated by reference to FIGS. 2,3, and 5, the heart of this invention resides in an enlarged weight bearing segment 25 formed on the neck portion 21 of the clothes hanger member 20.

Furthermore, as can best be seen by reference to FIG. 3, the enlarged weight bearing segment 25 has a continuously curved peripheral surface, the cross-sectional configuration of which is spheroidal in nature and may be circular, oval or elliptical in shape.

In the first version of the embodiment of the invention illustrated in solid lines in FIG. 3, the weight bearing segment 25 has an oval configuration of which the width "x" is at least twice the width y" of the remainder of the portions 21 22 23 24 that comprise the clothes hanger member 20.

In addition, in the second version of the preferred embodiment illustrated in phantom in FIG. 3, the weight bearing surface 25' has a width "x" that is at least three times the width of "y" of the remainder of the clothes hanger member 20.

Turning now to FIG. 5, it can be seen that the weight bearing segment 25 is also curved to conform to the top of a clothes hanger support pole 100 wherein, the length of the weight bearing segment 25 coincides with the weight bearing surface on the top portion of the hanger support pole 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

The invention claimed is:

1. A clothes hanger construction comprising a one piece molded plastic clothes hanger member having a neck portion, a pair of angled arm portions and a horizontal leg portion wherein, at least the arm portions and the leg portion have a uniform width "y" and the neck portion is provided with an enlarged weight bearing segment having a curved bottom wherein, the enlarged weight bearing segment has a width "x" and the value of "x" is at least twice the value of "y".

2. The construction as in claim 1, wherein, the enlarged weight bearing segment has a continuously curved peripheral surface.

3. The construction as in claim 2; wherein, the weight bearing segment has a spherical cross-sectional shape.

4. A clothes hanger construction comprising a one piece molded plastic clothes hanger member having a neck portion a pair of angled arm portions and a horizontal leg portion wherein at least the arm portions and the leg portion have a uniform width "y" and the neck portion is provided with an enlarged weight bearing segment having a curved bottom;

wherein, the enlarged weight bearing segment has a continuously curved peripheral surface;

wherein, the weight bearing segment has a spherical cross-sectional shape; and wherein, the enlarged weight bearing segment has a width "x" and the value of "x" is at least twice the value of "y".

* * * * *